United States Patent [19]

Roberts

[11] Patent Number: 4,505,653

[45] Date of Patent: Mar. 19, 1985

[54] CAPACITY CONTROL FOR ROTARY VANE COMPRESSOR

[75] Inventor: Richard W. Roberts, Lombard, Ill.

[73] Assignee: Borg-Warner Corporation, Chicago, Ill.

[21] Appl. No.: 498,998

[22] Filed: May 27, 1983

[51] Int. Cl.[3] ..... F04C 29/10

[52] U.S. Cl. ..... 418/23; 418/26; 418/268

[58] Field of Search ..... 418/268, 23, 82, 93, 418/26, 270; 62/228.3, 226, 228.5; 417/274

[56] References Cited

U.S. PATENT DOCUMENTS

| | | | |
|---|---|---|---|
| 2,280,272 | 4/1942 | Sullivan | 103/7 |
| 3,068,798 | 12/1962 | Machen | 417/394 X |
| 3,153,984 | 10/1964 | Fiske | 91/75 |
| 3,455,109 | 7/1969 | Daniels | 60/53 |
| 3,828,569 | 8/1974 | Weisgerber | 62/227 |
| 3,834,846 | 9/1974 | Linder et al. | 418/270 |
| 3,998,570 | 12/1976 | Jacobs | 62/228.3 X |
| 4,050,263 | 9/1977 | Adalbert et al. | 62/243 |
| 4,061,450 | 12/1977 | Christy | 418/253 |
| 4,103,506 | 8/1978 | Adalbert et al. | 62/61 |
| 4,384,462 | 5/1983 | Overman et al. | 62/228.3 X |

*Primary Examiner*—Edward K. Look

*Attorney, Agent, or Firm*—Florian S. Gregorczyk

[57] ABSTRACT

A capacity control circuit for a fluid displacement apparatus, especially for a rotary vane compressor, which circuit controls the volume of fluid displaced or transmitted through such apparatus. The present invention provides a means to retain the vanes within the rotor guide slits with a fluid pressure differential to modulate the volume throughput of such rotary vane compressor or apparatus. This vane control is provided by controlling the suction or input pressure to such apparatus through a fluid control valve.

5 Claims, 5 Drawing Figures

CAPACITY CONTROL FOR ROTARY VANE COMPRESSOR

BACKGROUND OF THE INVENTION

1. Field

The invention relates generally to the control of a fluid displacement apparatus, by controlling the volume of fluid displaced or transmitted through such apparatus in response to an external parameter. More specifically, this invention relates to a rotary vane compressor frequently utilized for passenger compartment air conditioning on automobiles. In such compressors, retention of the vanes in their retracted position stops the pumping action. The present invention discloses a control circuit to provide for vane retention in the retracted position to modulate the compressor output in response to changing engine speeds, and cooling loads. It retains the present clutch mechanism for complete disengagement of the compressor from the driving means.

2. Prior Art

Control of the output or discharge from a compressor or rotary vane fluid displacement apparatus by control of the vanes has been demonstrated in the art. Methods usually employed to retain or retract these vanes utilize a mechanical clamping device, electromechanical device, control of a clutch or the use of a regulator valve to control the discharge pressure. U.S. Pat. No. 2,280,272 to Sullivan discloses a blade guide to maintain the blades or vanes in contact with the compression chamber wall. The outlet pressure in Sullivan U.S. Pat. No. 2,280,272 is regulated with a regulating valve at the regulating port. A fluid motor as taught in U.S. Pat. No. 3,153,984 (Fiske) utilizes a flexible spring subject to fluid pressure to maintain the vanes extended from the guide slits in a compression chamber of such fluid displacement apparatus. The vanes in this fluid motor are displaced into the guide slits as they pass fulcrum points on the pressure chamber wall but are not retained in the guide slits. A rotary vane pump generally for use with an hydraulic transmission is disclosed in U.S. Pat. No. 3,455,109 (Daniels) wherein vane movement within or displacement from the guide slit is controlled through a pilot valve, clutch means and double-acting piston arrangement operable at the root of the vane guide slits. Fluid is introduced to either side of the double-acting piston to extend or retract the vanes. U.S. Pat. No. 3,828,569 (Weisgerber) teaches the use of refrigerant fluid to force the vanes to radially extend themselves to maintain contact with the pressure chamber wall. U.S. Pat. Nos. 4,050,263 and 4,103,506 (Adalbert et al.) recognize the value of modulating the flow of an automobile air conditioning compressor by maintaining the vanes of a rotary vane compressor in the retracted mode. The vanes, in this instance, are retained by a locking member actuated by a solenoid which is responsive to engine speed. The locking member is moved axially to contact a projection of a vane, and in fact, the vanes are arrested in pairs, as taught therein. U.S. Pat. No. 4,061,450 (Christy) discloses a set of mechanically connected arms and vanes where such arms are joined to a journal to provide reciprocal movement to the vanes during rotation of the rotor.

SUMMARY OF THE INVENTION

The invention encompasses fluid control means utilizing a fluid control valve to maintain the sliding vanes in a rotary vane compressor in their retracted or extended position. The actuation of the control circuit is responsive to engine speed to modulate fluid flow through the apparatus. The fluid control valve provides a means of utilizing the differential between inlet and outlet pressures of this compressor to retain these vanes therein with no mechanical or electrical connections thereto. The use of a clutch means, as known in the art, for long-term disengagement or engagement of the compressor to the power means, may be retained in the invention.

In an automotive environment the compressor is operable at clutch engagement, however, it is desirable to modulate the fluid flow through the compressor as a function of engine or vehicle speed and cooling load. This ability to control a fluid flow without cycling of the clutch provides a means to modulate the suction pressure and thus the temperature of the evaporator independent of engine speed. Such modulation prevents the evaporator from icing up at high engine speeds, such as at high-speed highway travel.

In the normal operating mode the fluid control valve provides direct communication between the discharge or outlet passage and the root of the vanes to provide a force to maintain vane contact with the pressure chamber wall. At a predetermined engine speed, evaporator pressure or some other monitored operating parameter, the fluid control valve is moved to provide inlet or evaporator pressure to the root of the vanes and discharge pressure is introduced to the compression chamber to hold the vanes in a retracted position in their slots. Further, a fluid inlet check valve is provided to seal flow through an inlet port from the source of inlet pressure when the pressure chamber is at the discharge pressure. Therefore, the fluid flow in the system is stopped as long as the vanes are retracted. Decreased fluid flow in the compressor chamber results in a consequent reduction in compressor output, which reduces the mechanical work required to drive the compressor.

BRIEF DESCRIPTION OF THE DRAWINGS

In the figures of the drawings, like reference numerals identify like components and in the drawings.

DETAILED DESCRIPTION OF THE INVENTION

Figure 1:
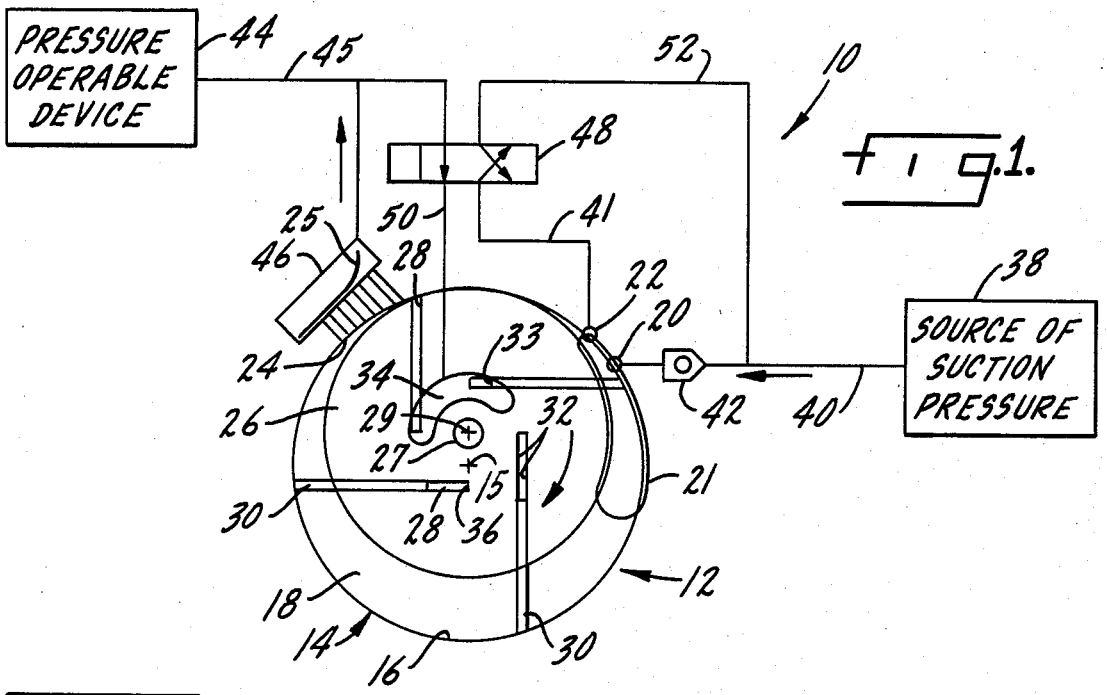
FIG. 1 is a schematic diagram of a preferred embodiment of the fluid control circuit, fluid control valve and a rotary vane fluid displacement apparatus wherein the compressor is in the normal or working mode with the vanes extended.
Figure 2:
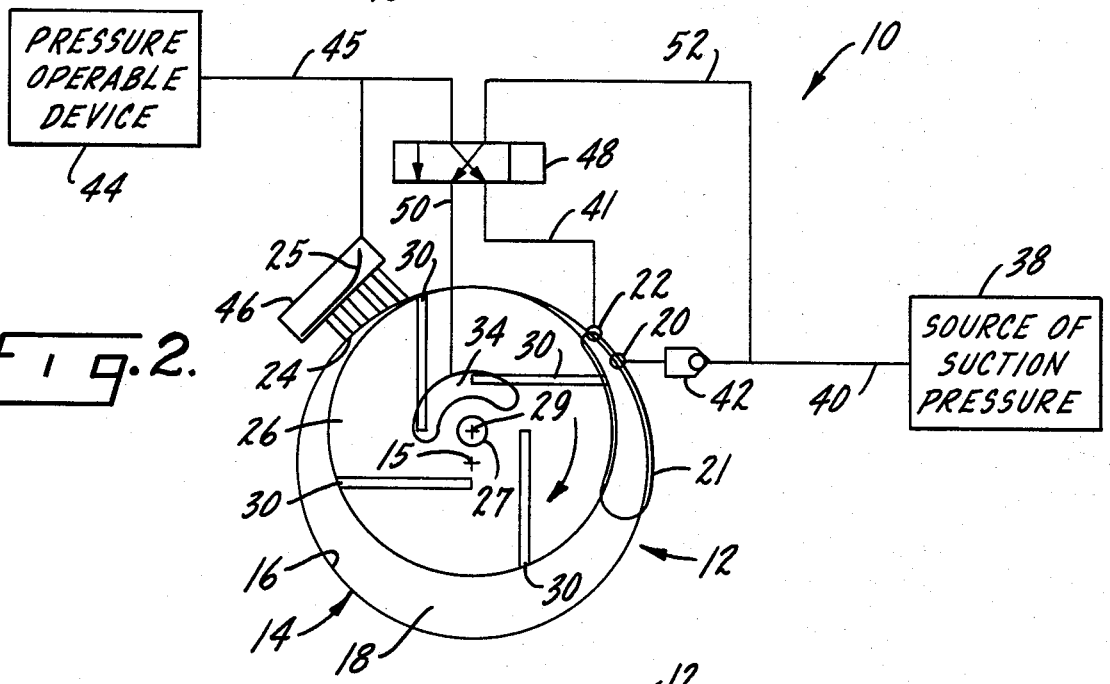
FIG. 2 is a schematic diagram as in FIG. 1 wherein the vanes are in the retracted or non-working mode.
Figure 5:
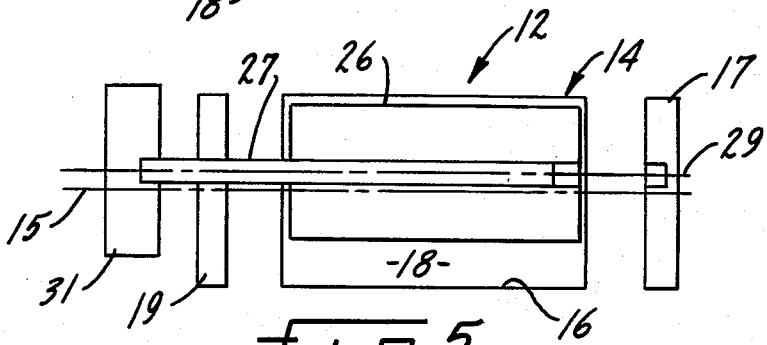
FIG. 5 is an exploded block diagram illustrating the longitudinal parts relationship in a typical compressor structure.

The control circuit or arrangement 10 of the present invention is operable to modulate the fluid flow of a rotary vane fluid displacement apparatus 12 as shown in FIGS. 1 and 2. FIG. 5 is illustrative of the longitudinal relationship in an automotive rotary vane air-conditioning compressor, which is a type of a rotary vane fluid displacement apparatus 12. Such an apparatus includes a cylindrical housing 14 having a longitudinal or reference axis 15 and defining an inner wall 16. A first end plate 17 is positioned on one end of housing 14 and a second endplate 19 is positioned on the other end of housing 14. Endplates 17 and 19, a housing 14 cooperate to define a pressure chamber 18. A rotor 26 is shown as mounted on a drive shaft 27 and positioned in pressure chamber 18. Rotor 26 contacts first end plate 17 and extends to second end plate 19, which end plates seal chamber 18 of housing 14. Drive shaft 27 has a longitudinal axis 29 which is in the same plane and parallel to but offset from housing axis 15 such that the rotor comes into tangential contact with the housing internal wall 16 between a discharge port and suction port. Drive shaft 27 extends through second end plate 19 and is coupled to a clutch means 31 which is connectable to a drive means (not shown) by any means known in the art.

In the diagrammatic illustration of FIG. 1 apparatus 12 includes a housing 14, which housing 14 is depicted as circular on end. Housing 14 defines an inner wall 16, a pressure or compression chamber 18 therein, a suction or inlet port 21, a first suction or inlet connecting means 20, a second suction or inlet connecting means 22 and at least one discharge port 24 covered by a flapper valve 25. As shown in FIGS. 1 and 2 apparatus 12 has a cylindrical shape and a longitudinal axis 15. Positioned in chamber 18 is a rotor 26 with a longitudinal axis 29 displaced from but parallel to the longitudinal axis 15 of housing 14. Rotor 26 may be mounted on a drive shaft 27 as in FIG. 5 or it may define an extending member therefrom to provide a driving force thereto, as known in the art. In addition, the sealing and bearing requirements for such shafts or extending members are well known in the prior art and are not shown herein.

Rotor 26 defines at least two longitudinal guide slits 28 with sidewalls 32 and a root 36 in proximity to drive shaft 27, wherein slidable vanes 30 are restrained to reciprocate between an extended working position and a withdrawn non-working position. In the working position the vanes 30 define segmented crescent-shaped pockets therebetween in chamber 18. These vanes 30 define a root 33 in proximity to guide slit root 36 and extend to contact inner wall 16 in the working position. An endplate 19, illustrated in exploded view of FIG. 5, defines an arcuate control port or cavity 34 in FIGS. 1 and 2 which communicates fluid to the roots 36 of guide slits 28.

A source of suction pressure 38 communicates with inlet port 21 through first inlet connecting means 20 and a conduit means 40 coupled therebetween. A check valve or fluid inlet valve 42 is positioned in conduit means 40 between inlet connecting means 20 and the source of suction pressure. Fluid inlet valve 42 permits flow therethrough when the source of suction pressure or compressible fluid 38 is at a greater pressure than that pressure at first inlet connecting means 20. A fluid pressure operable device 44 is coupled by a conduit means 45 to a fluid discharge valve 46 mounted at discharge port 24.

A fluid control valve 48 is provided in the control circuit 10 and is illustrated in FIG. 1 in its first or working position. Valve 48 is slidably operable to provide fluid communication through a conduit means 50 between discharge fluid conduit means 45 and arcuate cavity 34 to communicate fluid at discharge pressure to the vane root 33 in the working mode of apparatus 11. This discharge pressure acts on vanes 30 to extend them outwardly from guide slits 28 to contact inner wall 16. Similarly, fluid valve 48 in its second or non-working position shown in FIG. 2 may be coupled to inlet port 21 through second inlet connecting means 22, a conduit means 41 and conduit means 45 to communicate discharge pressure to pressure chamber 18. Further, in the non-working mode suction pressure is communicated to arcuate cavity 34 through conduit means 50, control valve 48, and a conduit means 52 communicating between valve 48 and conduit means 40. Thus check valve 42 is exposed to discharge pressure, greater than inlet pressure, acting to seal communication through check valve 42 from the source of suction pressure 38.

In this first or working position valve 48 provides communication between the discharge pressure at valve 46 and arcuate cavity 34, and consequently to the slit roots 36 forcing the vanes into contact with inner wall 16. When the discharge pressure is communicated to chamber 18 through connecting means 22, as in the second or non-working mode, and the pressure at the vane roots 33 is at suction pressure, the pressure differential acts to maintain vanes 30 in the retracted position in guide slits 28. In this non-working mode both chamber 18 and conduit 45 are at discharge pressure. Discharge valve flapper 25 remains closed when the pressure differential between chamber 18 and vane roots 33 is great enough to overcome the rotary motion action (centrifugal force) on slide vanes 30 which would slide them to their extended or working position.

Figure 3:
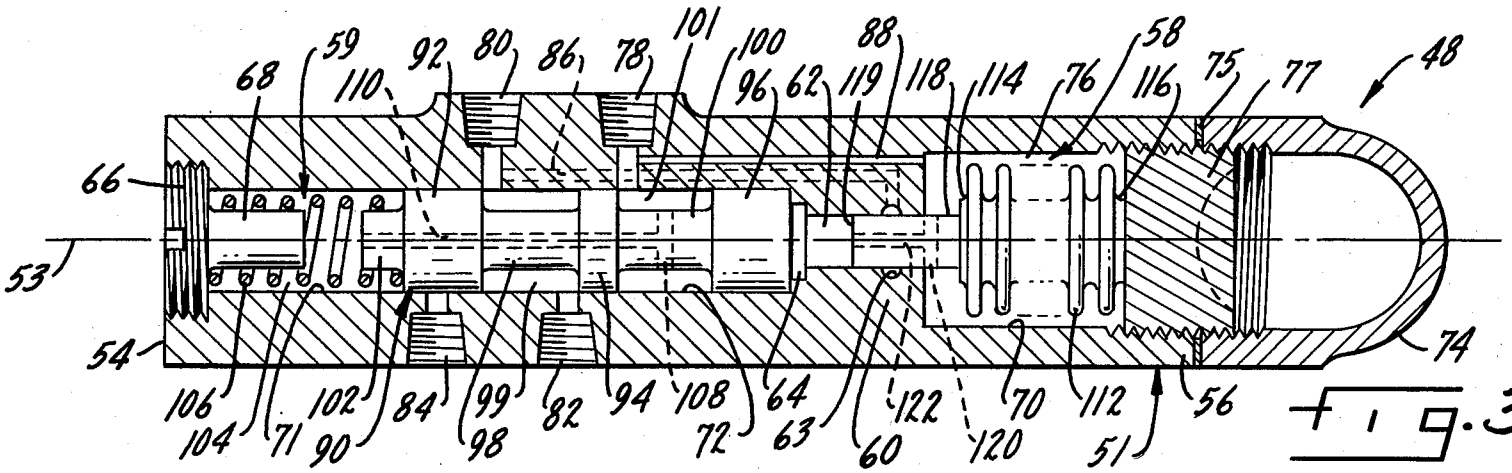
FIG. 3 is a detailed cross-sectional view of the fluid control valve in the compressor working mode.
Figure 4:
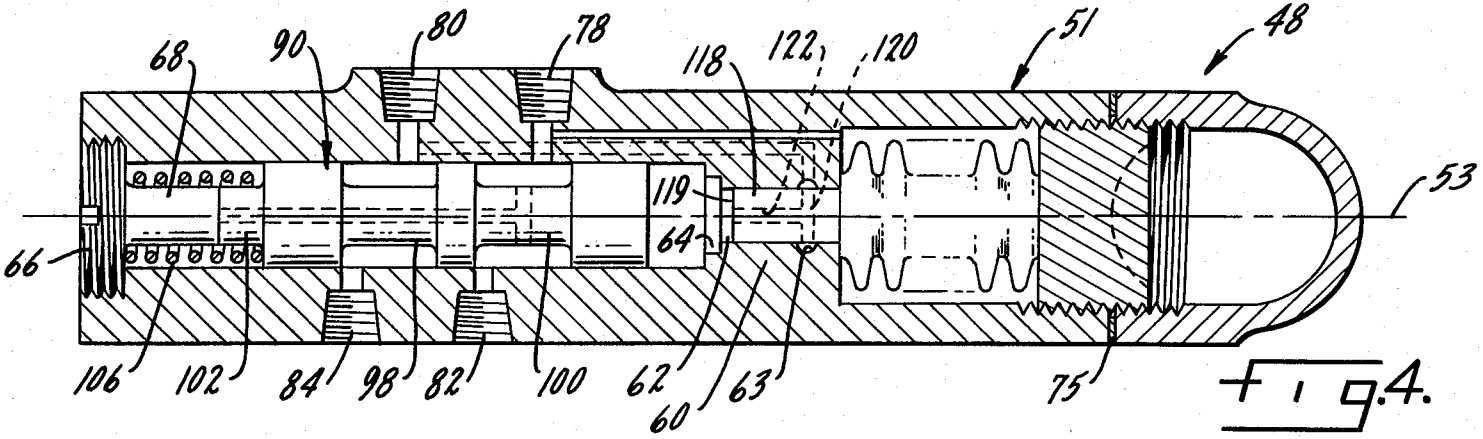
FIG. 4 is a detailed cross-sectional view of the fluid control valve in the compressor non-working mode.

Fluid control valve 48 is shown in FIGS. 3 and 4 in cross-section in the working or vane-extended position of FIG. 1 and in the non-working or vane-retracted position of FIG. 2, respectively.

Control valve 48 includes a cylindrical valve housing 51 with a longitudinal reference axis 53, first end 54 and second end 56. Housing 51 defines a bellows bore 58 with sidewall 70, a slide valve bore 59 with sidewall 71 and a contracted area or neck 60 therebetween. Neck 60 defines a through bore or channel 62, an annulus 63 and a recess 64. A plug 66 having an extending member or stub-stop 68 is sealingly mounted at first end 54 to seal longitudinal bore 59. Extending member 68 protrudes into bore 59 coaxially with axis 53. Plug 66, a sidewall 71 and neck 60 cooperate to define a slide or first chamber 72 in bore 59. A seal means 74 and gasket 75 are mounted to seal second end 56 of housing 50. An adjustable threaded plug 77 is mounted in second end 56 of housing 51. Neck 60, sidewall 70 and threaded plug 77 cooperate to define a bellows or second chamber 76. Housing 51 further defines a suction pressure port 78, a discharge pressure port 80, a vane root pressure port 82 and a compression chamber pressure port 84. A first passage means 86 defined by housing 51 communicates between discharge pressure port 80 and annulus 63. A second passage means 88 defined by housing 51 communicates between suction pressure port 78 and belows chamber 76.

A slide 90, defining a first land 92, a second land 94, a third land 96 with first and second groove segments 98 and 100 respectively, therebetween. Further, lands 92, 94, 96 and groove segments 98 and 100 cooperate with sidewall 71 to define annular segments 99 and 101, respectively, between the lands 92, 94, 96 in slide chamber 72. Slide 90 is slidably operable along axis 53 in slide valve bore 59. Slide 90 defines a protuberance 102 extending from first land 92 along axis 53 toward first end 54 which protuberance 102 may contact extending member 68 as in FIG. 4 to limit the travel of slide 90 toward first end 54. Slide 90, plug 66 and sidewall 71 cooperate to define a bias spring chamber 104 wherein a bias spring 106 is positioned to contact plug 66 and slide 90 to bias said slide in a direction of second end 56. Slide 90 further defines a cross-hole 108 through groove 100 and a bore passage means 110 communicating between cross-hole 108 and bias spring chamber 104, to maintain chamber 104 at suction or inlet pressure at all times.

An expandable bellows 112, such as the Sylphon type, with first end 114 and second end 116 is positioned in bellows chamber 76 to contact threaded plug 77 at second end 116 and is expandably operable to contact neck 60. Bellows 112 includes a cylindrical extension member 118 extending from bellows first end 114 into neck bore 62 with a head end 119. Extension member 118 is slidably operable in neck bore 62. Cylindrical extension member 118 defines a through-hole 120 which communicates with annulus 63 when bellows 112 contacts neck 60 as in FIG. 4. Further, cylindrical extension member 118 defines a longitudinal passage means 122 communicating between extension head end 119 and through-hole 120.

Control valve 48 operates to control the introduction of suction and discharge pressure to the pressure chamber 18 or arcuate cavity 34 thereby controlling the working or non-working modes of the compressor. Bellows 112 is of a predetermined flexural strength and in the working positions of FIGS. 1 and 3 is exposed to suction pressure through port 78 and passage 88. Below a predetermined suction pressure bellows 112 expands to the position shown in FIG. 4. In the reference or compressed position of bellows 112 as in FIG. 3, extension 118 and thus through-hole 120 are out of register with annulus 63 thereby severing communication of discharge pressure to recess 64 and land 96 of slide 90, and introducing suction pressure to recess 64 from chamber 76. Therefore, the pressure forces operating on slide 90 are balanced and bias spring 106 moves and holds slide 90 in contact with neck 60.

In an automobile air conditioning compressor when such automobile is operating at higher speeds, the suction or evaporator pressure will decrease below the predetermined level necessary to compress bellows 112. Below that predetermined pressure bellows 112 will expand to contact neck 60 and move extending member 118. When bellows 112 expands to contact neck 60, through-hole 120 is in register with annulus 63 to communicate discharge pressure from discharge pressure port 80, through passage 86, annulus 63, passage 122, recess 64 and chamber 72 to act on land 96 to move slide 90 in the direction of first end 54 of housing 51. Slide 90 is biased by spring 106 and suction pressure in bias spring chamber 104, therefore, the pressure differential between discharge pressure and suction pressure must be greater than the bias force of spring 100 to move slide 90 toward first end 54. The travel of slide 90 is constrained by contact of its protuberance 102 and extending member 68.

In this control valve non-working position illustrated in FIG. 4 discharge pressure is communicated from discharge port 80 past groove 98 to compression chamber port 84 for communication to the connecting means 22 and ultimately compression chamber 18 of apparatus 12. Simultaneously communication is provided for suction pressure from suction pressure port 78, past groove 100, to vane root port 82 for communication to arcuate chamber 34 and thus guide slit root 36.

When the pressure differential between suction and discharge pressure is adequate to overcome bias spring 106 of control valve 48 such pressure differential is also adequate to retain vanes 30 in guide slits 28 against the rotary motion, generally termed centrifugal force, causing the vanes 30 to slide outward to contact compression chamber wall 16. When the suction pressure increases, bellows 77 is compressed to the reference position shown in FIG. 3. Recess 64 is again vented to suction pressure, and spring 106 returns slide 90 to its reference or working position wherein suction pressure is again communicated to compression chamber 18 and discharge pressure is communicated to the vane roots 36. Thus the pressure or fluid compression cycle of the compressor or fluid displacement apparatus 12 is modulated in a relatively simple and economical manner.

Those skilled in the art will recognize that certain variations can be made in the illustrated embodiments. While only specific embodiments of the invention have been described and shown, it is apparent that various alterations and modifications can be made therein. It is, therefore, the intention in the appended claims to cover all such modifications and alternations as may fall within the true scope and spirit of the invention.

I claim:

1. A control arrangement for a rotary vane fluid displacement apparatus including a fluid control valve, which valve comprises a valve housing having a longitudinal reference axis and defining a first end and a second end, a first or slide chamber and sidewall, a second or bellows chamber and a connecting channel between said first and second chambers;

said valve housing being sealed at said first end by a plug defining a stub-stop protruding into said first chamber along said reference axis, said second chamber being sealed at said housing second end by a seal means and an adjustable threaded plug;

a slide, coaxial with said longitudinal reference axis, and slidably operable in said first chamber defining a first land, a second land and a third land with a first and second cylindrical segments and groove segments, respectively, therebetween;

said valve housing first end, slide valve bore sidewall and first land of said slide cooperating to define a bias spring chamber therebetween;

said slide further defining a protuberance extending into said spring chamber from said first land longitudinally toward said stub-stop;

a bias spring positioned in said spring chamber between said first end of said valve housing and said first land to bias said slide;

an expandable bellows mounted in said second chamber contacting said threaded plug and including an extension member with a protruding head end extending into said connecting channel and slidable therein by said bellows;

said valve housing further defining a discharge port, a suction pressure port, a compression chamber port and a valve control port which communicate, in that order, between said first chamber and a pressure operable device, a source of suction pressure, said second inlet connecting means and said fluid displacement control cavity;

said valve housing further defining an annulus in said connecting channel and a first passage means communicating between said discharge port and said annulus;

said bellows extension member defining a through-hole alignable with said annulus of said connecting channel when said bellows is compressed;

said bellows extension member further defining a longitudinal passage means communicating between said extension member head end and said extension member through-hole;

said slide defining a cross-hole in said second cylindrical segment and a bore passage means communicating between said cross-hole and said spring chamber; and wherein said fluid control valve is operable to communicate discharge or suction pressure to said control cavity in response to the differential between said discharge and suction pressures when such differential is great enough to overcome the bias force of said spring to thus provide a means to transfer discharge pressure from said valve control port to said compression chamber port and to simultaneously introduce suction pressure to said valve control port.

2. A control arrangement for a rotary vane fluid displacement apparatus including a housing having a reference axis, at least one endplate affixed to said housing to define therewith a compression chamber having an internal wall, a shaft extending through said housing and having an axis parallel to the reference axis, a rotor mounted on said shaft within said housing and defining a plurality of longitudinal guide slits, each slit having side walls with a root in proximity to said shaft, a plurality of slidable vanes, one of said vanes being disposed in each of said guide slits, each vane being operable between an extended working position and a retracted noworking position, said housing defining a discharge port and valve arrangement and, a first inlet connecting means and suction port which provides egress and ingress for a compressible fluid, respectively, said vanes, when contacting the compression chamber internal wall, defining segmented crescent-shaped pockets within the housing for transferring said compressible fluid to said discharge port and valve arrangement, wherein the improvement comprises a fluid inlet valve communicating between said first inlet connecting means and a source of compressible fluid at a suction pressure for said compression chamber, said endplate defining a control port or cavity to provide fluid pressure to said root of said guide slits, a second fluid inlet connecting means defined by said housing, and a fluid control valve, coupled to said control cavity operable to communicate suction pressure to said root of said guide slit and to simultaneously communicate compression fluid discharge pressure to said second inlet connecting means to maintain said vanes in said guide slits at said retracted non-working position by the pressure differential between said suction and discharge pressures.

3. A control arrangement for a rotary vane fluid displacement apparatus as claimed in claim 2, wherein said fluid inlet valve is operable to seal communication between said suction pressure source and said first inlet connecting means when said fluid control valve communicates suction pressure to said control cavity.

4. A control arrangement for a rotary vane fluid displacement apparatus including a housing having a reference axis, at least one endplate affixed to said housing to define therewith a compression chamber having an internal wall, a shaft extending through said housing and having an axis parallel to the reference axis, a rotor mounted on said shaft within said housing and defining a plurality of longitudinal guide slits, each slit having side walls with a root in proximity to said shaft, a plurality of slidable vanes, one of said vanes being disposed in each of said guide slits, each vane being operable between an extended working position and a retracted nonworking position, said housing defining a discharge port and valve arrangement and, a first inlet connecting means and suction port which provide egress and ingress for a compressible fluid, respectively, said vanes, when contacting the compression chamber internal wall, defining segmented crescent-shaped pockets within the housing for transferring said compressible fluid to said discharge port and valve arrangement, wherein the improvement comprises a fluid inlet valve communicating between said first inlet connecting means and a source of compressible fluid at a suction pressure for said compression chamber, said endplate defining a control port or cavity to provide fluid pressure to said root of said guide slits, a second fluid inlet connecting means defined by said housing, and a fluid control valve, coupled to said control cavity, operable to communicate discharge pressure to said root of said guide slit and to seal fluid communication to said second inlet connecting means to provide a pressure differential between said root and said compression chamber to maintain said vanes in the extended working positions.

5. A control arrangement for a rotary vane fluid displacement apparatus as claimed in claim 4, wherein said fluid inlet valve is operable to communicate flow between said suction pressure source and said compression chamber when said fluid control valve communicates discharge pressure to said control cavity.

* * * * *

UNITED STATES PATENT AND TRADEMARK OFFICE

CERTIFICATE OF CORRECTION

PATENT NO. : 4,505,653

DATED : March 19, 1985

INVENTOR(S) : RICHARD W. ROBERTS

It is certified that error appears in the above—identified patent and that said Letters Patent is hereby corrected as shown below:

Column 7, line 34, cancel "noworking" and insert -- nonworking --.

Signed and Sealed this

*Third* Day of *September 1985*

[SEAL]

*Attest:*

DONALD J. QUIGG

*Attesting Officer* *Acting Commissioner of Patents and Trademarks - Designate*